US009732946B2

(12) United States Patent
Abai et al.

(10) Patent No.: US 9,732,946 B2
(45) Date of Patent: Aug. 15, 2017

(54) LUMINAIRE CEILING MOUNTING MECHANISM

(71) Applicant: GE Lighting Solutions, LLC, Cleveland, OH (US)

(72) Inventors: Robert Abai, Budapest (HU); Bulcsu Simonyi, Budapest (HU); Armin Gyula Fendrik, Budapest (HU); Istvan Rozsas, Budapest (HU)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 305 days.

(21) Appl. No.: 14/278,897

(22) Filed: May 15, 2014

(65) Prior Publication Data

US 2015/0330611 A1 Nov. 19, 2015

(51) Int. Cl.

| | |
|---|---|
| ***F21S 8/08*** | (2006.01) |
| ***F21V 21/03*** | (2006.01) |
| ***F21V 21/04*** | (2006.01) |
| ***F21S 8/02*** | (2006.01) |

(52) U.S. Cl.

CPC ..... *F21V 21/03* (2013.01); *F21S 8/026* (2013.01); *F21V 21/04* (2013.01); *F21V 21/046* (2013.01); *Y10T 29/49948* (2015.01)

(58) Field of Classification Search

CPC ..... F21V 21/03; F21V 21/04; F21V 21/046; F21S 8/026; Y10T 29/49948

USPC ..... 362/418

See application file for complete search history.

(56) References Cited

U.S. PATENT DOCUMENTS 4,039,822 A * 8/1977 Chan ..... F21S 8/02 362/183
4,088,293 A * 5/1978 Delmore ..... F21V 21/04 248/343
4,685,037 A * 8/1987 Akiyama ..... F21V 21/04 337/113

(Continued)

FOREIGN PATENT DOCUMENTS

AU 411004 B2 3/1971
DE 102007036979 A1 11/2008

(Continued)

OTHER PUBLICATIONS

European Search Report and Opinion issued in connection with corresponding EP Application No. 15167640.0 on Jul. 20, 2015.

(Continued)

*Primary Examiner* — Bryon T Gyllstrom
(74) *Attorney, Agent, or Firm* — GE Global Patent Operation; Peter T. DiMauro

(57) ABSTRACT

Provided is a device including a base configured for attachment to a lighting fixture. The device also includes an engagement mechanism having first and second portions configured for mounting the lighting fixture within a recess of a substantially flat member having first and second ends. The engagement mechanism facilitates movement of the lighting fixture within the recess from the first end towards the second end, the movement (i) being responsive to an applied force and (ii) occurring in only a single direction. The first portion engages a first surface of the member and the second portion engages a second surface of the member when the lighting fixture reaches the second end.

19 Claims, 6 Drawing Sheets

(56) References Cited

U.S. PATENT DOCUMENTS

| | | | | | |
|---|---|---|---|---|---|
| 5,068,772 | A * | 11/1991 | Shapiro | F21V 21/04 | 248/343 |
| 5,122,944 | A * | 6/1992 | Webb | F21V 21/04 | 362/147 |
| 5,377,088 | A * | 12/1994 | Lecluze | F21V 21/04 | 248/343 |
| 5,567,041 | A * | 10/1996 | Slocum | F21S 8/02 | 362/148 |
| 5,964,523 | A * | 10/1999 | Eversberg | F21V 21/04 | 362/148 |
| 6,000,818 | A * | 12/1999 | Caluori | F21V 21/04 | 362/147 |
| 9,052,101 | B1 * | 6/2015 | Kathawate | F21V 21/046 | |
| 2005/0207146 | A1 * | 9/2005 | Reggiani | F21V 21/04 | 362/150 |
| 2010/0039829 | A1 * | 2/2010 | Tsai | F21S 8/026 | 362/373 |
| 2011/0235342 | A1 * | 9/2011 | Liang | F21V 21/04 | 362/364 |

FOREIGN PATENT DOCUMENTS

| | | | |
|---|---|---|---|
| DE | 202013008171 | U1 | 9/2013 |
| EP | 2140197 | A1 | 1/2010 |
| EP | 2314914 | A1 | 4/2011 |
| JP | 5745712 | U | 3/1982 |
| JP | 2870636 | B1 | 3/1999 |
| WO | 9618068 | A1 | 6/1996 |
| WO | 2012088721 | A1 | 7/2012 |

OTHER PUBLICATIONS http://www.youtube.com/watch?v=Tob89ByGhL4.

European Search Report and Opinion issued in connection with related European Application No. 16177855.0 dated Nov. 3, 2016.

* cited by examiner

LUMINAIRE CEILING MOUNTING MECHANISM

I. FIELD OF THE INVENTION

The present invention generally relates to installation of lighting fixtures, or luminaires. More particularly, the present invention relates to mechanisms for mounting luminaire systems in locations, such as ceilings, in a safe, efficient, and cost-effective manner.

II. BACKGROUND OF THE INVENTION

Luminaires are increasingly relied upon for white light production in downlight high-ceiling applications. These applications provide a lighting for offices, retail space settings, and other commercial applications. Additionally, more recently developed downlight luminaires also include advanced lighting technology that is inherently more sustainable, while providing significant energy savings than predecessor, or legacy systems.

High-ceiling luminaire applications, however, are generally associated with inherent maintenance inefficiencies. For example, in addition to costs associated with lamp replacement, lifts and scaffolding are usually required to safely perform installation and maintenance for high-ceiling luminaires. These installation and maintenance challenges are further complicated because many of these luminaires are recessed and simply difficult to install or remove.

To assist the installation process, many conventional downlight luminaires include sheet-metal fixing springs on opposing sides of the luminaire for recessed installations through carveouts in the ceiling. These conventional luminaires, however, have several shortcomings. During installation, as one example, installers must use their fingers to hold the springs under tension, while inserting the luminaire through the carveout. Such designs can present a risk of injury to the installer and can actually make the installation process more complicated.

III. SUMMARY OF THE EMBODIMENTS OF THE INVENTION

Given the aforementioned deficiencies, a need exists for mounting systems and methods to improve the ease of installation of luminaires, and other recessed fixtures, into a ceiling, wall, or into some other substantially flat member.

In certain circumstances, an embodiment of the present invention includes a device including a base configured for attachment to a lighting fixture. The device also includes an engagement mechanism having first and second portions configured for mounting the lighting fixture within a recess of a substantially flat member having first and second ends. The engagement mechanism facilitates movement of the lighting fixture within the recess from the first end towards the second end, the movement (i) being responsive to an applied force and (ii) occurring in only a single direction. The first portion engages a first surface of the member and the second portion engages a second surface of the member when the lighting fixture reaches the second end.

Exemplary embodiments of the present invention include a luminaire mounting mechanism for improving ease of installation of the luminaire into the ceiling. For example, the luminaire can be easily inserted into the ceiling with a single forward motion in only one direction. Thus, the need for pushing and pulling the luminaire in multiple directions, during installation, is completely eliminated. Such an approach simplifies the installation process and minimizes risk of injury while installing recessed fixtures through a ceiling carveout.

More specifically, mounting systems constructed in accordance with the embodiments allow installators greater freedom of movement, during installation. This enhanced freedom of movement is provided by eliminating the need to hold fixing springs under tension during insertion of the luminaire into the ceiling. This approach also helps to avoid possible injury to fingers when mounting clamps are used to pull the fixture up to the ceiling carveout. Additionally, components constructed in accordance with the embodiments can be formed of simple geometry, avoiding the use of complex shapes or technologies.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

IV. BRIEF DESCRIPTION OF THE DRAWINGS

Figure 1:
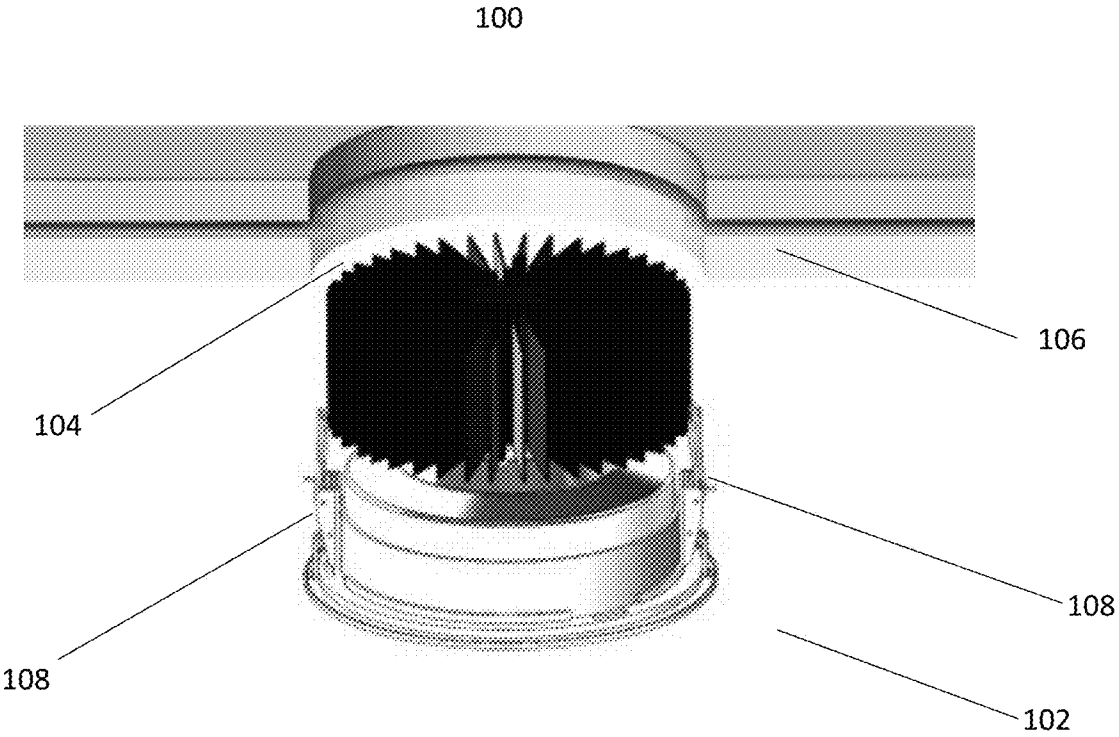
FIG. 1 is an illustration of an exemplary downlight luminaire and mounting mechanism system constructed in accordance with an embodiment of the present invention.

The present invention may take form in various components and arrangements of components, and in various process operations and arrangements of process operations. The present invention is illustrated in the accompanying drawings, throughout which, like reference numerals may indicate corresponding or similar parts in the various figures. The drawings are only for purposes of illustrating preferred embodiments and are not to be construed as limiting the invention. Given the following enabling description of the drawings, the novel aspects of the present invention should become evident to a person of ordinary skill in the art.

V. DETAILED DESCRIPTION OF VARIOUS EMBODIMENTS

While illustrative embodiments are described herein with illustrative embodiments for particular implementations, it should be understood that the invention is not limited thereto. Those skilled in the art with access to the teachings provided herein will recognize additional modifications, applications, and embodiments within the scope thereof, and additional fields in which the lighting systems described herein would be of significant utility.

The following detailed description is merely exemplary in nature and is not intended to limit the applications and uses disclosed herein. Further, there is no intention to be bound by any theory presented in the preceding background or summary or the following detailed description.

FIG. 1 is an illustration 100 of an exemplary downlight luminaire 102 configured for installation in a carveout area 104 of a substantially flat member, such as a ceiling 106. As noted above, the ceiling 106 may be associated with an office, a retail location, or similar environment. The luminaire 102 includes an exemplary mounting mechanism 108 constructed in accordance with an embodiment of the present invention.

The mounting mechanism 108, discussed in greater detail below, assists the installation process and improves ease of installation of the luminaire 102 into the ceiling 106. The exemplary mechanism 108 simplifies the installation process and reduces the risk of injury while installing recessed fixtures through the ceiling carveout 104. This approach facilitates faster and more efficient installation of recessed lighting fixtures.

In the exemplary embodiment of FIG. 1, the luminaire 102 can be easily inserted into the ceiling carveout 104 with a single forward motion occurring in only one direction. The installer is not required to push the luminaire in one direction for insertion through a carveout, then pull it in another direction to lock the luminaire into place, as required, using conventional approaches.

The mounting mechanism 108 also simplifies the installation process by eliminating the need for holding springs, or mounting clamps, under tension while inserting the luminaire through the carveout 104. In this manner, the risk of injury to an installer is substantially reduced.

Figure 2:
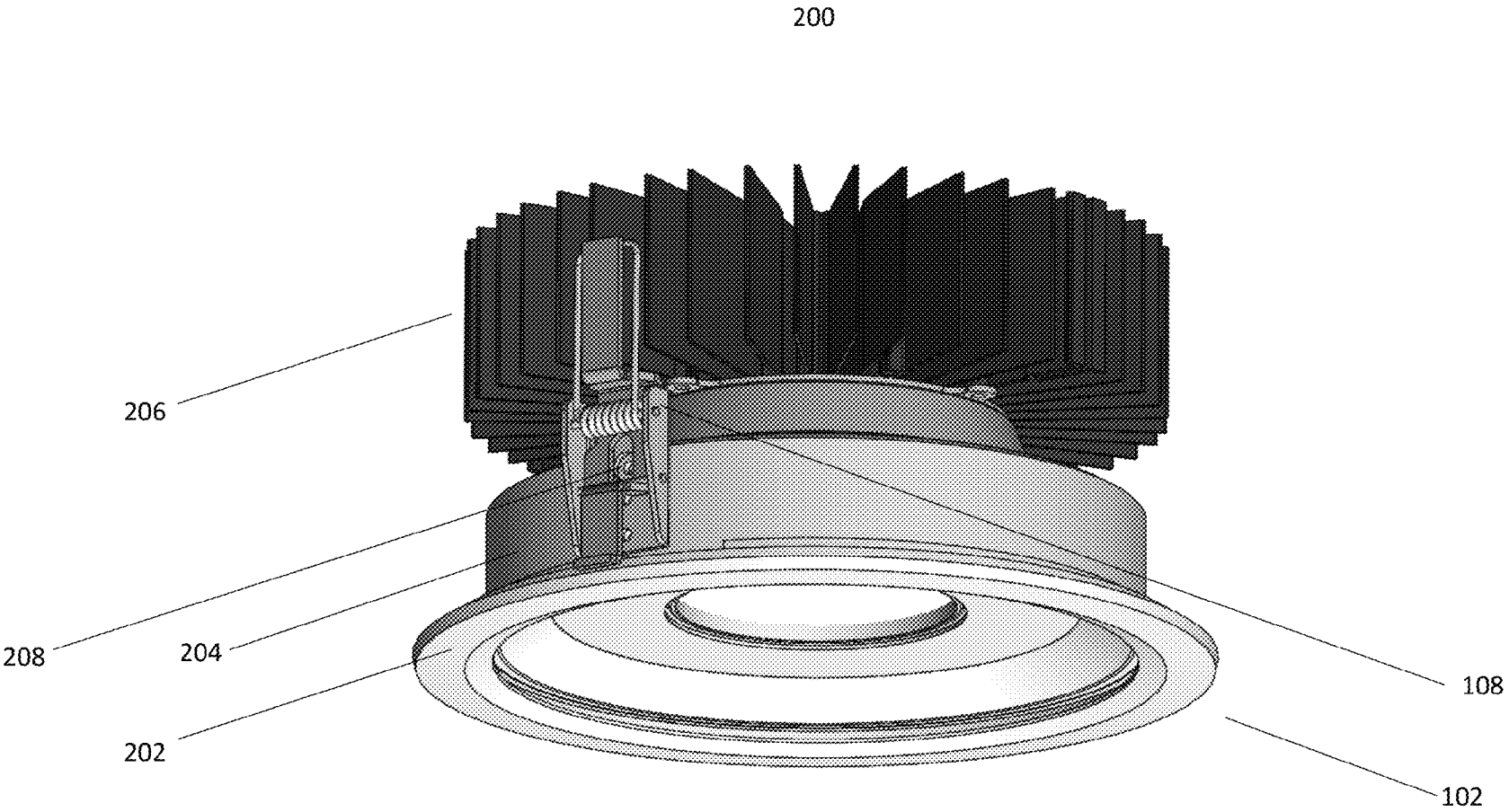
FIG. 2 is a more detailed illustration of the luminaire system and mounting mechanism depicted in FIG. 1.

FIG. 2 is a more detailed illustration 200 of the luminaire system 102 and the mounting mechanism 108 depicted in FIG. 1. By way of background, the luminaire system 102 includes a bezel 202, along with a housing 204 enclosing electronics, such as an infusion module and optics (not shown).

A passive heat sink 206 provides cooling for the infusion module, the optics, and other embedded electronics associated with the luminaire system 102. Standard fasteners, such as rivets or screws, can be inserted through an opening 208 to fasten the mounting mechanism 108 to the housing 204.

Figure 3B:
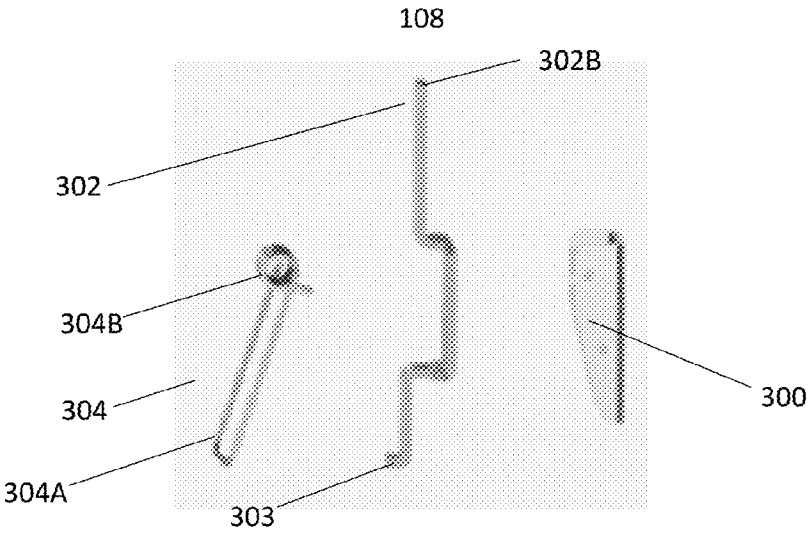
FIG. 3B is an exploded view of the mounting mechanism illustrated in FIG. 3A.
Figure 3A:
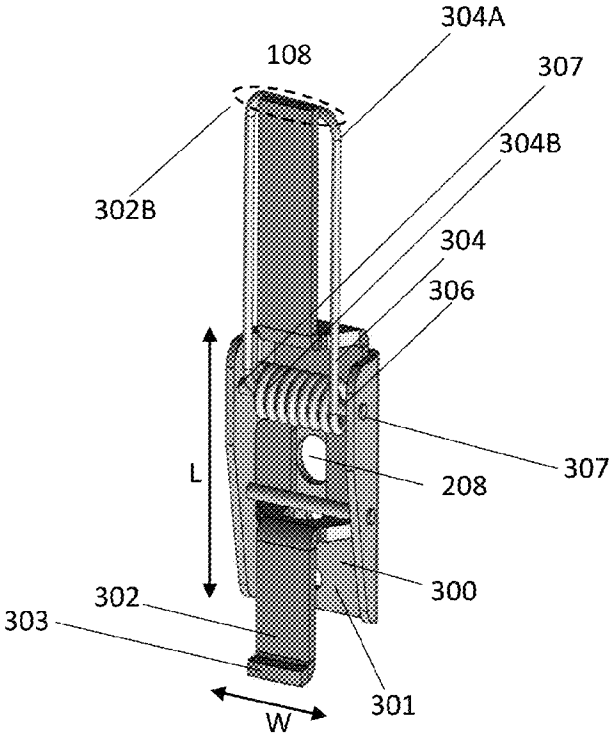
FIG. 3A is a detailed illustration of the mounting mechanism depicted in FIGS. 1 and 2 in accordance with the embodiments.

FIG. 3A is a detailed angular view of the mounting mechanism 108, shown in FIGS. 1 and 2. In FIG. 3A, the mounting mechanism 108 includes a bracket (e.g., base) 300, and an elongated clamp lock 302 slidably fastened within a pathway 301 of the bracket 300. For example, the clamp lock 302 is configured for slidable (i.e., up and down) movement in a lengthwise direction (L) within the pathway 301. A lip portion 303 of the clamp lock 302 is provided for locking the luminaire system 102 tightly within the ceiling carveout 104 during installation.

A spring arm 304A of a spring clamp 304 is positioned in substantially parallel alignment with the clamp lock 302. The spring clamp 304 also includes a spring coil 304B attached atop an upper surface of the clamp lock 302 and fastened to the bracket 300 about a pin 306, axially disposed through the spring coil 304B. The embodiments of the present invention are not limited to the spring clamp 304 depicted in FIGS. 2-3. Other suitable spring clamp configurations are available, as understood by those of skill in the art, and would be within the spirit and scope of the present invention.

The pin 306 is attached to sides of the bracket 300 through openings 307 in a widthwise direction (W). Prior to installation of the luminaire system 102, as illustrated more fully below, the spring arm 304A is locked into the substantially parallel arrangement (i.e., vertical position) with the clamp lock 302 via a clamp lock top portion 302B.

FIG. 3B provides an exploded view of the mounting mechanism 108 of FIG. 3A, along with more detailed views of the bracket 300, the clamp lock 302, the clamp lock top portion 302B, the lip 303, the spring clamp 304, the spring arm 304A, and the spring coil 304B.

Figure 4B:
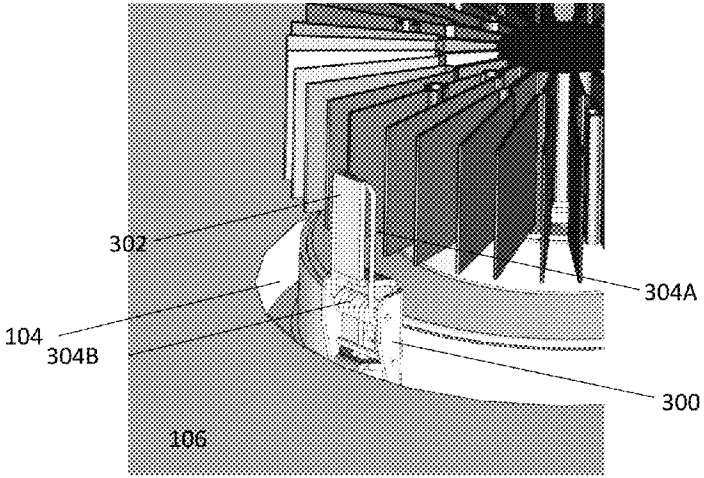
FIG. 4B is a more detailed illustration of the mounting mechanism of FIG. 4A prior to installation.
Figure 4A:
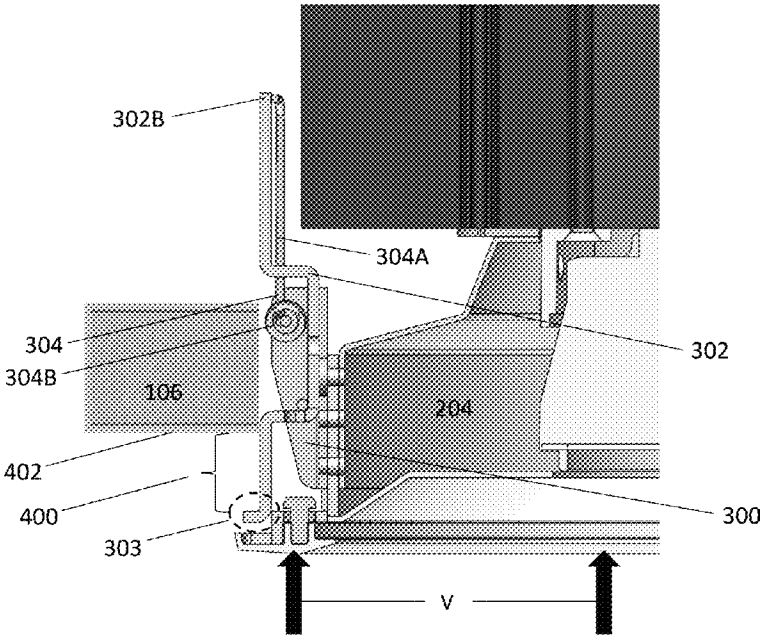
FIG. 4A is an illustration of the mounting mechanism of FIG. 2 prior to installation in a ceiling carveout.

FIG. 4A is an illustration of the mounting mechanism 108, attached to the housing 204, prior to installation of the luminaire 102 through the ceiling carveout 104. Before installation, the spring arm 304A is in locked substantially vertical alignment with the clamp lock top portion 302B, as shown. A distance 400 separates the lip portion 303 from a bottom surface 402 of the ceiling 106.

FIG. 4B is a more detailed illustration of the mounting mechanism 108, shown in of FIG. 4A, prior to installation. In FIG. 4B, the locked vertical alignment between the spring arm 304A and the clamp lock top portion 302B is more clearly visible. As noted above, the mounting mechanism 108 provides a more stable installation of the luminaire system 102 within the carveout area 104. To facilitate installation, and installer need only position the luminaire system 102 within the carveout area 104 and gently apply pressure to the luminaire 102 in a vertical direction (V) to facilitate its secure positioning.

Figure 5B:
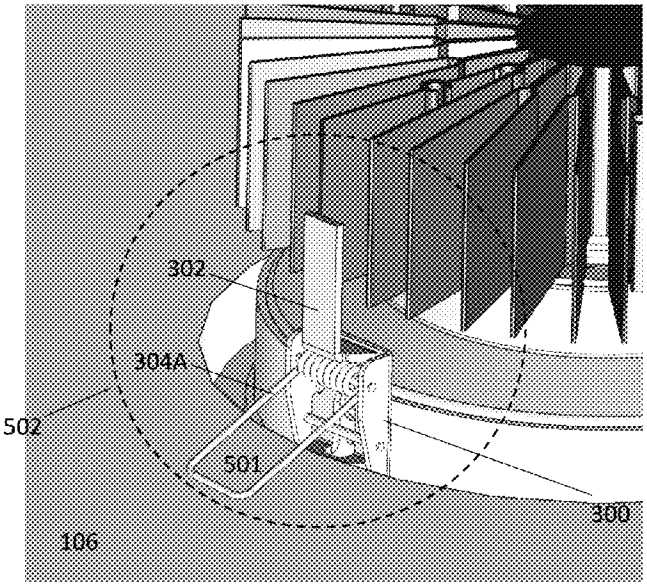
FIG. 5B is a more detailed illustration of the mounting mechanism of FIG. 4B after installation.
Figure 5A:
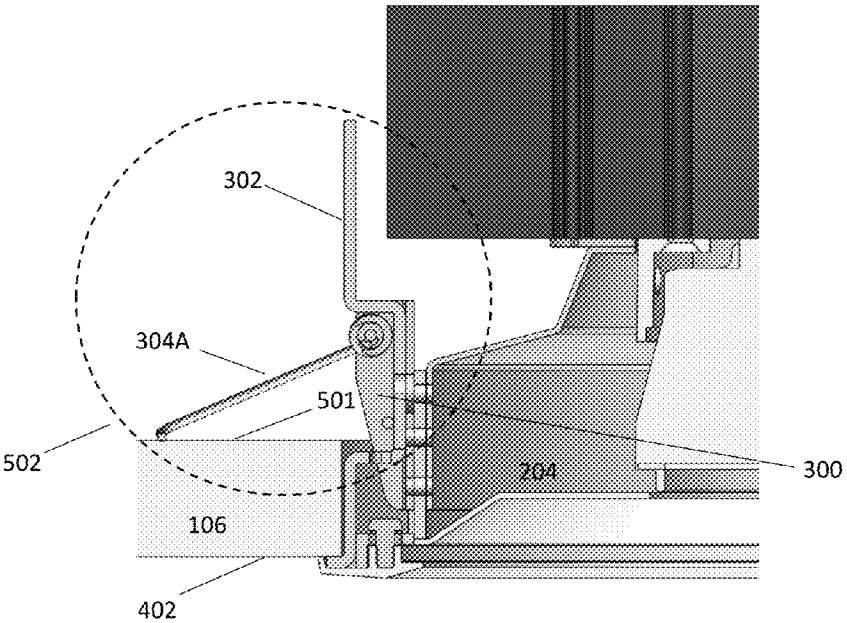
FIG. 5A is an illustration of the mounting mechanism of FIG. 4A, after installation in the ceiling carveout, in accordance with the embodiments.

FIG. 5A is an illustration of the mounting mechanism 108, after installation of the luminaire system 102 in the ceiling carveout 104, in accordance with the illustrious embodiments. After the installer applies pressure in the vertical direction (V), as discussed above, the entire mounting mechanism 108 moves vertically until the distance 400 decreases to 0. The gap 400 disappears when the lip 303 contacts (i.e., hooks onto) the bottom surface 402 of the ceiling 106.

When contact is established between the lip 303 and the bottom surface 402, as the luminaire moves in the vertical direction (V), the bracket 300 and the spring arm 304A continue to move vertically. During this vertical movement, the clamp lock 302 remains in the vertically locked position.

As the bracket 300 and the spring arm 304 continue moving vertically, a tip of the spring arm 304A eventually rises above the clamp lock top portion 302B, releasing the locked position of the spring arm 304A. Tension within the spring coil 304B releases the locked vertical alignment, forcing the spring arm 304A to press against a top surface 501 of the ceiling 106. This process is illustrated with reference character 502 of FIG. 5A.

As discussed above, the lip portion 303 can be released, or pushed by use of an installer's finger. Such a release could become necessary, for example, if one or more surfaces of the ceiling 106 is deformed or otherwise irregular, or if the edge of the ceiling 106 is not sharp enough to activate the mounting mechanism 108.

FIG. 5B is a more detailed illustration of the spring arm 304 released to press against the top surface 501 of the ceiling 106 to secure the installation of the luminaire 102.

Figure 6A:
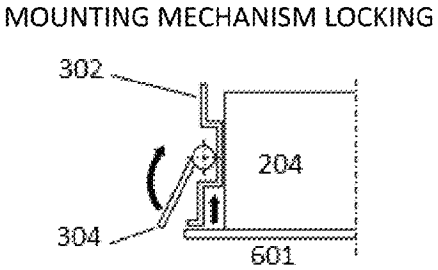
FIG. 6A is an illustration of a mounting mechanism attached to housing, during an exemplary locking step.

FIG. 6A is an illustration of the mounting mechanism 108, attached to the housing 204, during an exemplary locking step 601. Prior to installation, an installer may lock the mounting mechanism 108, in preparation for installation, by rotating the clamp spring 304 up to vertical position beyond clamp lock 302, in step 601. Step 601 prepares the luminaire 102 for insertion through the ceiling carveout 104.

Figure 6B:
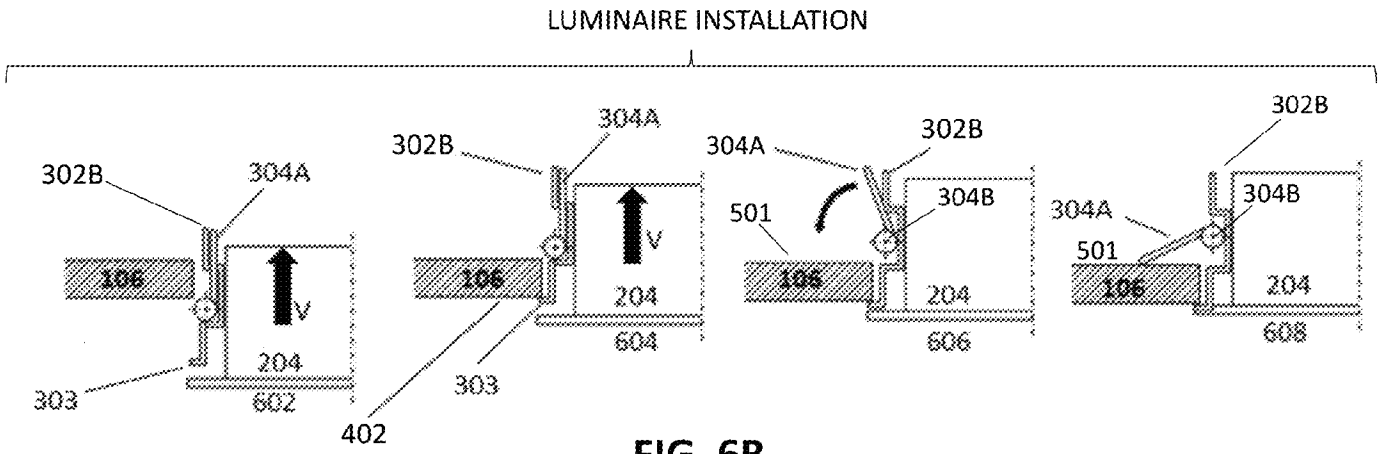
FIG. 6B is an illustration of exemplary stages occurring during installation of the luminaire into the ceiling through the carveout.

FIG. 6B is an illustration of exemplary stages occurring during installation of the luminaire 102 (attached to the housing 204) through the carveout 104. For example, in positioning stages 602 and 604, after the luminaire 102 is inserted through the carveout 104, an installer need only push the luminaire 102 in a vertical direction (V), as indicated by the arrow. As the installer continues to push the luminaire 102, positioning it forward in the vertical direction (V), the clamp lock 302 prevents the spring arm 304A from being released during positioning. More particularly, as depicted in stage 604, the spring arm 304A is prevented from being released until the lip 303 contacts the bottom surface 402 of ceiling 106.

When the vertical movement of the luminaire 102 causes the spring arm 304A to extend vertically beyond a height of the clamp lock top portion 302B, as depicted at stage 606, the spring arm 304A is released. Upon release, the spring arm 304A rotates in a direction towards the top surface 501, as depicted in stage 606. The release of the spring arm 304A occurs as a result of tension created moment within the spring coil 304B. Thus, when the spring arm 304A is released, spring tension is applied to the top surface 501 of the ceiling 106 to complete positioning of the luminaire 102, as depicted at stage 608. This tension continues to pull the entire luminaire system 102, in the vertical direction (V), securing it into a stable position.

CONCLUSION

Those skilled in the art, particularly in light of the foregoing teachings, may make alternative embodiments, examples, and modifications that would still be encompassed by the technology. Further, it should be understood that the terminology used to describe the technology is intended to be in the nature of words of description rather than of limitation.

Those skilled in the art will also appreciate that various adaptations and modifications of the preferred and alternative embodiments described above can be configured without departing from the scope and spirit of the technology. Therefore, it is to be understood that, within the scope of the appended claims, the invention may be practiced other than as specifically described herein.

We claim:

1. A device, comprising:

an engagement mechanism having first and second portions configured for mounting a lighting fixture within a recess of a substantially flat member, the recess having first and second ends;

wherein the engagement mechanism comprises a bracket, the bracket having a pathway formed of a bottom and two sides, the first and second portions being attached to the bracket; wherein the engagement mechanism facilitates movement of the lighting fixture within the recess from the first end to the second end, the movement (i) being responsive to an applied force and (ii) occurring in only a single direction;

wherein the first portion is configured for slidable movement in only one direction within the pathway;

wherein the second portion is positioned in parallel alignment with the first portion; and wherein the first portion engages a first surface of the substantially flat member and the second portion engages a second surface of the substantially flat member when the lighting fixture reaches the second end.

2. The device of claim 1, wherein the force is externally applied, and wherein the first portion is a locking mechanism.

3. The device of claim 2, wherein the second portion is a tension applying mechanism.

4. The device of claim 3, wherein the tension applying mechanism includes at least one from the group including a coil, a machined spring, and a flat spring.

5. The device of claim 1, wherein the substantially flat member includes at least one from the group including a ceiling and a wall.

6. The device of claim 5, where the recess is a carveout area in the ceiling.

7. The device of claim 6, wherein the first surface is one side of the ceiling and the second surface is the other side of the ceiling.

8. The device of claim 1, wherein the lighting fixture is a recessed luminaire.

9. A device for mounting a lighting fixture within a recess of a substantially flat member, comprising:

a bracket (i) having a pathway formed of a bottom and two sides and (ii) configured for attachment to the lighting fixture;

a locking mechanism (i) having a lip portion and (ii) configured for slidable movement in only one direction within the pathway in response to an applied force; and a tension mechanism positioned in substantially parallel alignment with the locking mechanism;

wherein when the force is applied, the is tension mechanism engages a first surface of the substantially flat member and the lip portion engages a second surface thereof.

10. The device of claim 9, wherein the lighting fixture is a recessed luminaire.

11. The device of claim 10, wherein the substantially flat member includes at least one from the group including a ceiling and a wall.

12. The device of claim 11, wherein the bracket is attached to an exterior surface of the lighting fixture.

13. The device of claim 12, wherein the tension mechanism includes at least one from the group including a coil, a machined spring, and a flat spring.

14. The device of claim 9, wherein the tension mechanism engages the first surface of the substantially flat member when a tip of the tension mechanism rises above a top portion of the locking mechanism.

15. A method for mounting a lighting fixture within a recess of a substantially flat member, comprising:

inserting the lighting fixture in a first end of the recess, the lighting fixture having a bracket attached to an exterior surface thereof, the bracket having a pathway formed of a bottom and two sides and (ii) configured for attachment to the lighting fixture;

wherein a locking mechanism is configured for slidable movement in only one direction within the pathway, the locking mechanism (i) having a lip portion and (ii) configured for slidable movement in only one direction within the pathway in response to an applied force; and wherein a tension mechanism is positioned in a substantially parallel alignment with the locking mechanism; and applying an external force to move the lighting fixture from the first and to a second end of the recess;

wherein when the force is applied, the tension mechanism engages a first surface of the substantially flat member and the lip portion engages a second surface thereof.

16. The method of claim 15, wherein the lighting fixture is a recessed luminaire.

17. The method of claim 16, wherein the substantially flat member includes at least one from the group including a ceiling and a wall.

18. The method of claim 17, wherein the bracket is attached to an external surface of the lighting fixture.

19. The method of claim 18, wherein the tension mechanism is formed of at least one from the group including a coil, a machined spring, and a flat spring.

* * * * *